US005675885A

United States Patent [19]

Imahori et al.

[11] Patent Number: 5,675,885

[45] Date of Patent: Oct. 14, 1997

[54] METHOD OF WINDING A COIL FOR AN ELECTROACOUSTIC TRANSDUCER

[75] Inventors: Yoshio Imahori; Kazuhiro Yamaguchi, both of Shizuoka, Japan

[73] Assignee: Star Micronics Co., Ltd., Shizuoka, Japan

[21] Appl. No.: 627,039

[22] Filed: Apr. 3, 1996

Related U.S. Application Data

[62] Division of Ser. No. 388,991, Feb. 15, 1995.

[30] Foreign Application Priority Data

Feb. 25, 1994 [JP] Japan ..... 6-053013

[51] Int. Cl.[6] ..... H01F 41/04

[52] U.S. Cl. ..... 29/594; 29/605; 29/609.1; 367/175; 381/201

[58] Field of Search ..... 29/605, 609.1, 29/594, 602.1; 367/175; 381/192, 201

[56] References Cited

U.S. PATENT DOCUMENTS

| | | | |
|---|---|---|---|
| 3,159,907 | 12/1964 | Bloom | 29/605 |
| 4,462,152 | 7/1984 | Okamoto et al. | 29/605 X |
| 5,305,961 | 4/1994 | Errard et al. | 29/605 X |

*Primary Examiner*—Carl E. Hall

*Attorney, Agent, or Firm*—Pollock, Vande Sande & Priddy

[57] ABSTRACT

An automated method for winding a coil of an electroacoustic transducer utilizes a support member that has a frusto-conical projection for receiving an outer pole tip. The frusto-conical configuration assures that, upon completion of a coil winding about the pole, there is an exposed recess around the periphery of the pole tip. This is accompanied by an end surface of the winding being coplanar with the corresponding end surface of the pole tip. Maximized performance for the transducer may then be realized.

3 Claims, 6 Drawing Sheets

METHOD OF WINDING A COIL FOR AN ELECTROACOUSTIC TRANSDUCER

This application is a divisional of U.S. patent application Ser. No. 08/388,991, filed Feb. 15, 1995.

BACKGROUND OF THE INVENTION

1. Field of the Invention

The present invention relates to an electroacoustic transducer which converts an electric signal into sound by electromagnetic conversion and a method of winding a coil therein.

2. Description of the Related Art

FIG. 6 shows an internal structure of an average electroacoustic transducer of prior art. The electroacoustic transducer comprises the components of a housing 102, a yoke 104, a pole 106, a coil 108, a magnet 110, a diaphragm 112 etc. A magnetic piece 114 is attached to the central portion of upper surface of the diaphragm 112 as a means for increasing the substantial oscillating mass thereof, and the housing 102 forms a resonance chamber 116 at the upper side of the diaphragm 112 to which the magnetic piece 114 is attached. A sound emitting cylinder 118 is formed in the housing 102 as a means for emitting resonance sound generated in the resonance chamber 116 to the outside. The sound emitting cylinder 118 comprises a sound emitting hole 120 therein for allowing the resonance chamber 116 to be open to the atmosphere.

The yoke 104 is provided at an opening formed on the rear side of the housing 102, the pole 106 constituting a magnetic core is attached to the center of the yoke 104 at a base portion 107 thereof by way of press fit etc. and the coil 108 is wound around the pole 106. The cylindrical magnet 110 is provided around the coil 108 and the diaphragm 112 is provided at the upper surface side of the magnet 110. The diaphragm 112 formed of a plate of magnetic material is held on the magnet 110 by the magnetic force thereof. There is a gap 122 between the lower surface of the diaphragm 112 and the end surface of the pole 106 forming a space for permitting the diaphragm 112 to vibrate therein.

In such an electroacoustic transducer, the magnet 110, the yoke 104, the pole 106, the gap 122, the diaphragm 112 and the magnetic piece 114 form a closed magnetic path. The magnet 110 applies a bias magnetic field to the diaphragm 112. The coil 108 comprises terminals, not shown, to which an electric signal to be converted into sound is applied. When the electric signal energizes the coil 108, an alternating magnetic field is generated about the pole 106 of the magnetic core to be applied to the diaphragm 112 so as to vibrate the same. The vibration of the diaphragm 112 vibrates air in the resonance chamber 116 to generate resonance sound therein, which is emitted to the outside through the sound emitting hole 120. The level and frequency of this sound depend on the inputted electric signal, and it is known that the acoustic characteristic of the electroacoustic transducer largely influences the characteristic of the generated sound as another element.

The magnetic field generated about the pole 106 depends on the number of turns of the coil 108. That is, although increasing the number of turns of the coil 108 is necessary to generate a stronger magnetic field, the electroacoustic transducer is required to be made small, so that there is naturally a limitation in increasing the number of turns of the coil 108.

In a conventional electroacoustic transducer as illustrated in FIG. 6, a side surface 124 of the coil 108 at the tip end side of the pole 106 has been made flat. It has been a common form of the coil 108 in case the same is wound around the pole 106 directly or by way of a bobbin.

On the other hand, for example, "an electroacoustic transducer" disclosed in Japanese Utility Model Laid-Open Publication No. 2-120998teaches winding a coil around a pole to form a flat surface conforming to the tip end surface of the pole and then retracting the side surface gradually toward the outer periphery thereof to form a conical side surface. This method expands an effective space for the coil, but is unreasonable in that the coil must be made small in height since the amplitude of vibration is maximum at the center of the diaphragm.

In the case of the electroacoustic transducer, the automation of manufacturing is requested for reducing the manufacturing cost and meeting the increase of demand. In case of conventional electroacoustic transducers, components are individually machined to be assembled manually thereafter. Therefore, continued processes of forming components and automation of assembling the electroacoustic transducer have been tried for reducing the manufacturing cost.

Moreover, although the electroacoustic transducer is requested to be miniaturized for use in a portable telephone etc., miniaturization to the extreme causes the deterioration of vibration characteristic of the decrease of magnetic force generated by the coil, so that it has to meet a contradictory request of miniaturization without the deterioration of acoustic performance or the decrease of magnetic force generated by the coil.

SUMMARY OF THE INVENTION

Therefore, it is the first object of the present invention to provide an electroacoustic transducer which is increased in winding efficiency of a coil on a pole of a pole piece portion.

It is the second object of the present invention to provide a method of winding a coil in an electroacoustic transducer which is increased in winding efficiency of a coil on a pole, of a pole piece portion and in which the winding process is automated.

In order to attain the first object of the present invention, the electroacoustic transducer for vibrating a diaphragm 18 by a magnetic field generated in response to an inputted electric signal to convert the electric signal into sound as illustrated in FIGS. 1 and 2 comprises the following components. That is, a pole piece portion 2 composed of a yoke 4 and a pole 6 provided on the upper surface of the yoke 4. The yoke 4 of the pole piece portion 2 being disposed at the rear side of a housing 24 and the end surface of the pole 6 being disposed apart from the diaphragm 18 by a gap 22, a coil 10 wound around the pole of the pole piece portion 2. The coil 10 is wound around the pole 6 with the peripheral surface of the tip end side thereof exposed to form the side surfaces **14*a* and 14*b* of the coil 10. The side surface 14*b* is set to be on a plane conforming or adjacent to the tip end surface of the pole 6 and an annular magnet 16 which is provided on the upper surface of the yoke 4 for applying a bias magnetic field to the diaphragm 18** so as to magnetize and hold the same.

As described above in the electroacoustic transducer according to the present invention, the coil 10 is wound around the pole 6 to cover the same while the peripheral surface of the tip end side of the pole 6 is exposed, so that it is possible to secure the number of turns equivalent to the case the coil 10 is wound around the pole 6 solidly. In other words, it is possible to secure the number of turns which is no less than that of a conventional coil while a portion of the pole 6 is exposed from the coil 10 so that the generated magnetic field is prevented from being degraded. Moreover, the vibration of the diaphragm is maximum at the center thereof and is gradually reduced toward the periphery thereof, so that such a form of the coil 10 corresponds to the vibrating form of the diaphragm and consequently the winding space of the coil 10 can be enlarged to generate magnetic force efficiently. As a result, it can contribute to the miniaturization of the electroacoustic transducer while realizing an acoustic output larger than the conventional one.

The side surface 14 of the coil 10 is set on a plane conforming or adjacent to the tip end surface 12 of the pole 6.

In the electroacoustic transducer of the present invention (FIG.2), the side surface 14 of the coil 10 is composed of a first side surface 14*a* which is funnel-shaped to expose the peripheral surface of the tip end side of the pole 6 and a second side surface 14*b* forming a flat plane conforming or adjacent to the tip end surface of the pole 6.

With this structure, it is possible to form a uniform side surface for a uniform magnetic characteristic so as to contribute to manufacturing a product which is stable in acoustic performance.

In order to attain the second object of the present invention, a method of winding the coil 10 in the electroacoustic transducer for vibrating the diaphragm 18 by a magnetic field generated in response to an inputted electric signal to convert the electric signal into sound as illustrated in FIGS. 3 to 5 comprises the following steps. That is, positioning a shaping member 32 having a shaping surface 40 on the tip end portion side of the pole 6 while holding the pole piece portion 2 at the yoke 4 side thereof by a holding member 31, the shaping member 32 comprising a holding projection 41 which has a recess 38 for receiving the tip end portion of the pole 6 therein. Member 32 further includes a first shaping surface 40*a* which is a conical surface formed at the central portion of the end surface of the holding projection 41 and a second shaping surface 40*b* forming a flat plane conforming or adjacent to the tip end surface 12 of the pole 6. Winding a wire 44 occurs around the pole 6 in a space 43 defined by the internal surface of the yoke 4 of the pole piece portion 2 and the first and second shaping surfaces 40*a* and 40*b* of the shaping member 32 so as to form the coil 10.

As described above, the method of manufacturing the electroacoustic transducer according to the present invention is just positioning the shaping member 32 on the tip end side of the pole 6 while holding the pole piece portion 2 at the yoke 4 side thereof, and winding the coil 10 around the pole 6, whereby the shaping surface 40 of the shaping member 32 forms the side surface of the coil 10. That is, since the shaping member 32 has a shaping surface 40*b* which is set to be on a plane conforming or adjacent to the tip end surface of the pole 6, the side surface 14*b* of the coil 10 is formed on a plane conforming or adjacent to the tip end surface of the pole 6. The manufacturing method using such a shaping member 32 can automate the winding process of the coil 10 around the pole 6 to obtain the coil 10 having a stable and uniform characteristic only by controlling the number of turns and consequently an electroacoustic transducer of high reliability and uniform characteristic, also contributing to the miniaturization thereof. Particularly in the case of a small-sized electroacoustic transducer, it contributes to the improvement of production yield.

In the method of winding the coil 10 in the electroacoustic transducer according to the present invention, the pole piece portion 2 may be held only by the shaping member 32 at the tip end side of the pole 6 thereof instead of by the holding member 31 at the yoke 4 side thereof. The wire 44 is wound around the pole 6 in the space 43 defined by the internal surface of the yoke 4 of the pole piece portion 2 and the first and second shaping surfaces 40*a* and 40*b* of the shaping member. 32 so as to form the coil 10.

As described above, holding the pole piece portion 2 by the shaping member 32 at the pole 6 side thereof obviates the holding member 31. It simplifies not only the whole device but also the winding process of the coil 10 since the process for the holding member 31 is eliminated.

DESCRIPTION OF THE PREFERRED EMBODIMENT

The present invention will be described in detail hereinafter with reference to embodiments illustrated in drawings.

Figure 1:
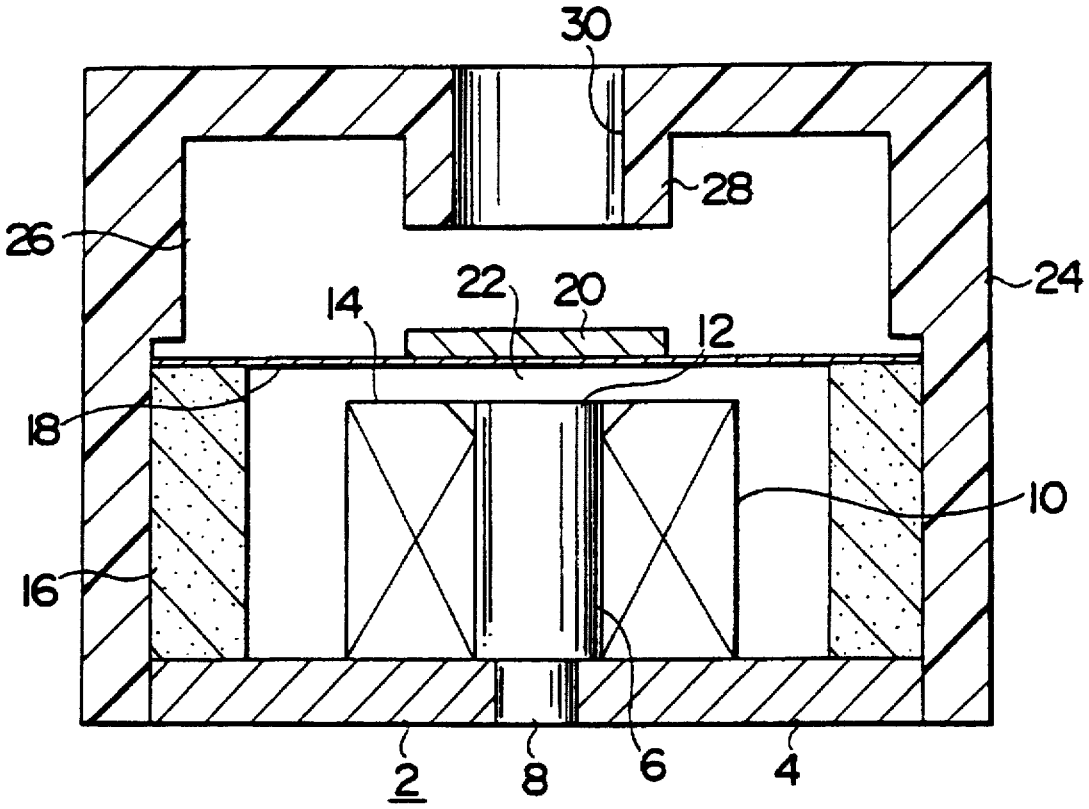
FIG. 1 is a cross section of an electroacoustic transducer according to an embodiment of the present invention.
Figure 2:
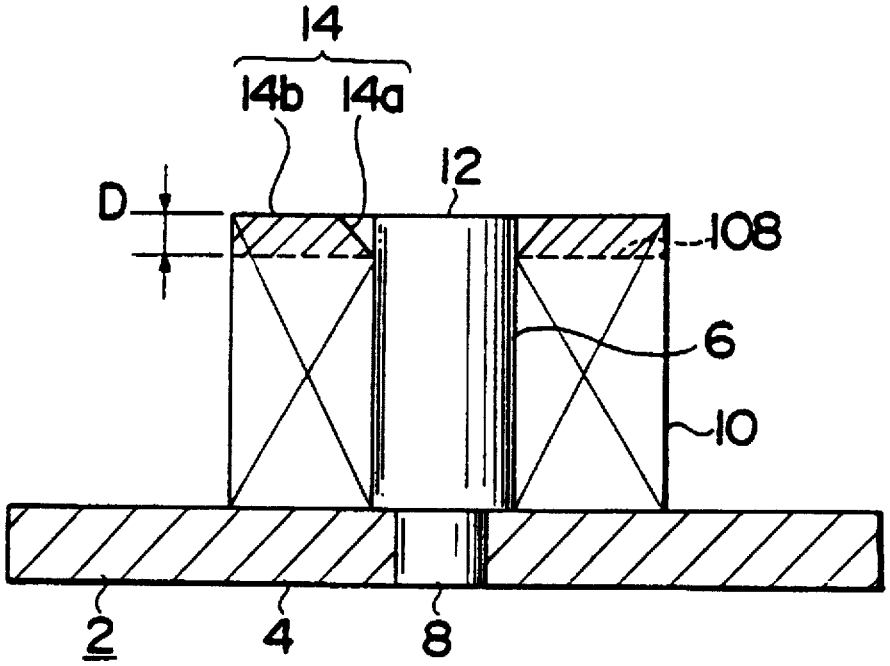
FIG. 2 is a cross section of a pole piece portion around which a coil is wound in the electroacoustic transducer illustrated in FIG. 1.

FIG. 1 shows an electroacoustic transducer according to an embodiment of the present invention and FIG. 2 shows a pole piece portion around which a coil is wound in FIG. 1.

The pole piece portion 2 of the electroacoustic transducer is composed of a yoke 4 having a shape of disc and a pole 6, and the pole 6 is attached to the central portion of the yoke 4 at a base end portion 8 thereof by way of a fixing means such as press fit etc., the pole 6 being smaller in diameter at the base end portion 8 thereof.

A coil 10 is wound around the pole 6 to be cylindrical coaxially with the pole 6 at the peripheral portion thereof. The coil 10 is made flat on the yoke 4 at the side of the base end portion 8 of the pole 6 and a side surface 14 which is different in shape from that of prior art is formed at the side of the tip end surface 12 of the pole 6, the side surface 14 being composed of first and second side surfaces 14*a* and 14*b* which are different in shape from each other. That is, the first side surface 14*a* is funnel-shaped to expose a part of the tip end portion of the pole 6, while the second side surface 14*b* is a flat plane conforming or adjacent to the tip end surface of the pole 6. As a result, the coil 10 is increased in the number of effective turns (increased portion is hatched) by a height D (FIG. 2) in the axial direction of the pole 6 to increase a winding efficiency compared with a conventional coil 108 (FIG. 6), the upper surface of which is indicated by a broken line in FIG. 2. Supposing that the coil 10 is the same in outer diameter and material as the conventional coil 108, it is possible to reinforce the magnetic field by that generated by the height D.

The electroacoustic transducer of this invention is the same in construction as a conventional electroacoustic transducer (FIG. 6) wherein an annular magnet 16 is provided about the pole 6 on the pole piece portion 2 and is fixed thereto. A diaphragm 18 is provided on the magnet 16 and a magnetic piece 20 is attached to the central portion of the diaphragm 18 as a means to increase the substantial vibrating mass thereof. According to this embodiment, a gap 22 is formed between the diaphragm 18 and the tip end surface 12 of the pole 6 as a means for forming a space to allow the vibration of the diaphragm 18 therein by setting the height of the magnet 16 higher than that of the pole 6. The diaphragm 18 and the magnetic piece 20 are made of magnetic material and the magnet 16 holds the diaphragm 18 thereon by way of its magnetic function and applies a bias magnetic field to the diaphragm 18 as a means for generating a magnetic oscillation. Similar to the conventional electroacoustic transducer, the pole piece portion 2, the magnet 16, the gap 22, the diaphragm 18 and the magnetic piece 20 constitute a single closed magnetic path and the coil 10, the yoke 4 and the pole 6 constitute a magnetic driving portion which converts an external electric signal into a magnetic field to be applied to the diaphragm 18.

The peripheral surface of the pole piece portion 2 and the upper surface side of the diaphragm 18 are covered by a housing 24. The housing 24 is a molded body of non-magnetic material such as synthetic resin etc. and comprises a resonance chamber 26 formed at the upper surface side of the diaphragm 18. A sound emitting cylinder 28 is formed in the housing 24 and a sound emitting hole 30 is formed in the sound emitting cylinder 28 for allowing the resonance chamber 26 to be open to the atmosphere and emitting a resonance sound thereto. Although the sound emitting cylinder 28 and the sound emitting hole 30 are formed about the central axis of the diaphragm 18 according to this embodiment, they may be formed otherwise.

When an external electric signal is applied to the terminals of the coil 10 in such an electroacoustic transducer, the coil 10 is energized in response to the level of the electric signal. As a result, the pole 6 generates an alternating magnetic field therearound which acts on the diaphragm 18 and the magnetic piece 20. Since a bias magnetic field is applied to the diaphragm 18 by the magnet 16, the diaphragm 18 receives a vertically vibrating force in response to the frequency and level of the alternating magnetic field superposed on the bias magnetic field. As a result, the diaphragm 18 vibrates to vibrate air at the upper and lower sides of the diaphragm 18 so as to resonate the resonance chamber 26. Accordingly, the vibrating sound of the diaphragm 18 and the resonance sound of the resonance chamber 26 are emitted to the outside through the sound emitting hole 30. Since the frequency of the resonance sound is distributed in the audio range, the electroacoustic transducer is used as a sound generating means such as a buzzer, etc.

In the case of the electroacoustic transducer of the present invention, the number of turns of the coil 10 is larger than the coil 108 of a conventional electroacoustic transducer by the height D and consequently generates a stronger magnetic field, which means that the magnetic force to vibrate the diaphragm 18 is stronger than that of prior art in response to the same input, so that the sound pressure of the electroacoustic transducer is reinforced.

Figure 6:
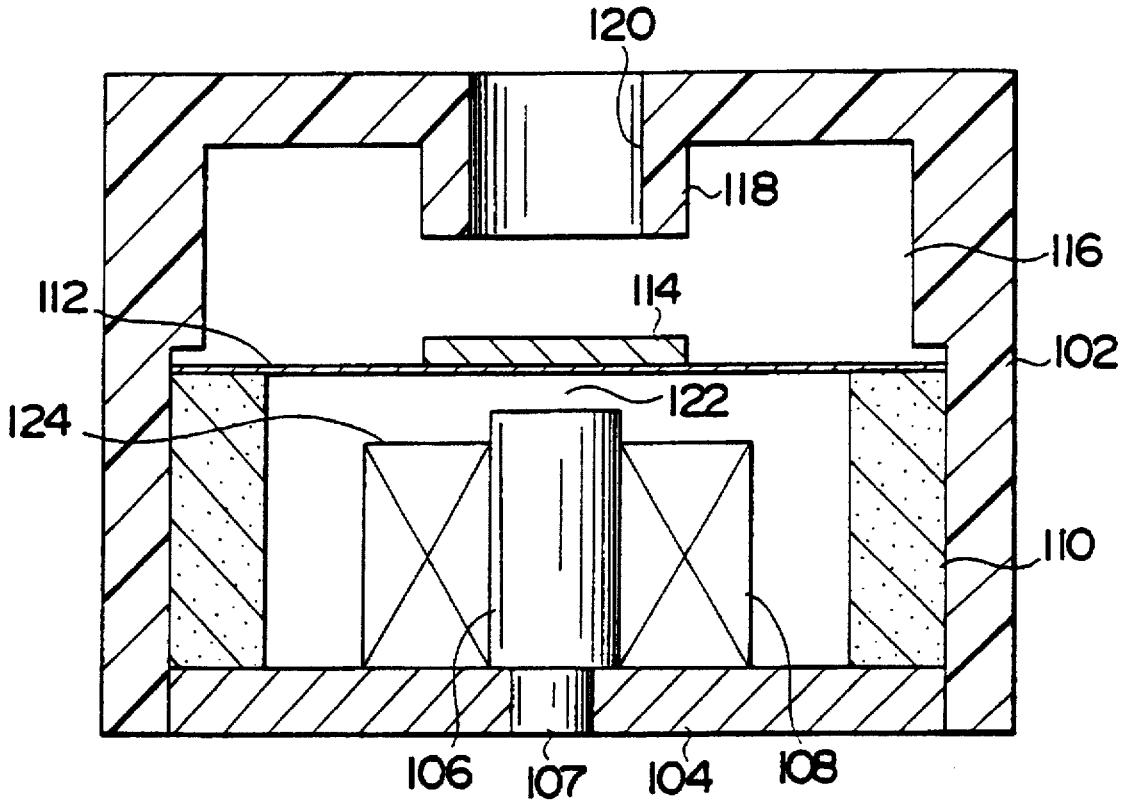
PRIOR ART FIG. 6
FIG. 6 is a longitudinal cross section of a conventional electroacoustic transducer.

Moreover, this characteristic brings on a change to the electroacoustic transducer itself or the input thereto in case of generating the same magnetic field as that of prior art. That is, electric power to be applied to the coil 10 can be reduced to generate a magnetic field equal to the conventional electroacoustic transducer (FIG. 6). Furthermore, to generate a conventional magnetic field in response to a conventional input, the pole 6 can be reduced in height that much. The reduction in height corresponds to reduction in the number of turns of the coil 10 by the height D, so that it is possible to reduce the electroacoustic transducer in height and dimensions.

Still furthermore, the coil 10 in the height D effectively makes use of a space at the rear side of the diaphragm 18 and does not prevent the vibration of the diaphragm 18 at all. It is because the vibration of the diaphragm 18 is maximum at the central portion thereof and is reduced toward the peripheral portion thereof. Consequently, the increase of the coil 10 by the height D increases the driving force thereof while generating the vibration of the diaphragm 18 similar to that of the conventional one.

Although in the electroacoustic transducer illustrated in FIGS. 1 and 2, the second side surface **14*b* of the coil 10 conforms to the tip end surface 12 of the pole 6, it may project from the tip end surface 12 of the pole 6 toward the diaphragm 18 or retract therefrom as far as it is adjacent to the tip end surface 12**.

Still furthermore, although the terminals are not shown in this embodiment, they may be formed of the ends of the coil 10 or may be formed as lead terminals at the rear side of the yoke 4 with an intervening insulator provided.

Figure 3A:
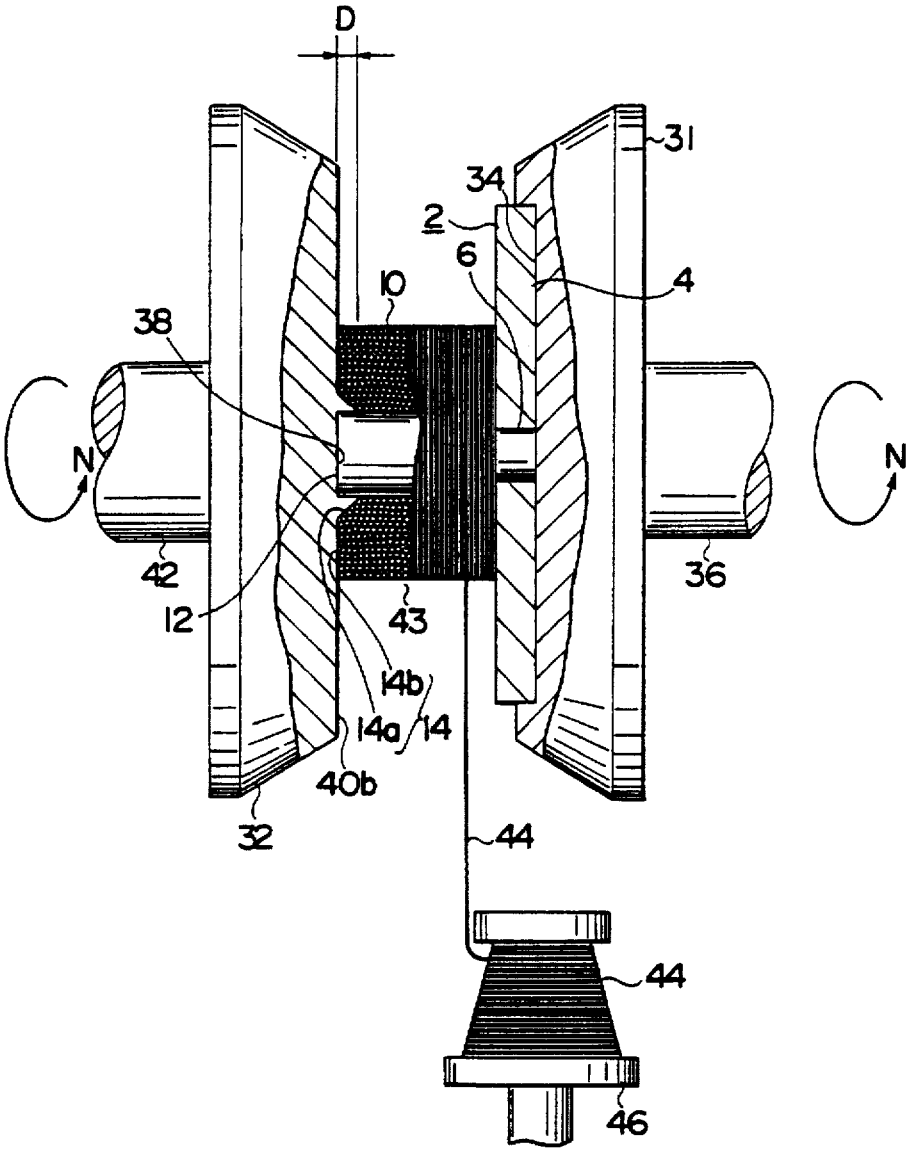
FIG. 3A is a view showing a method of winding a coil according to an embodiment of the present invention.
Figure 3B:
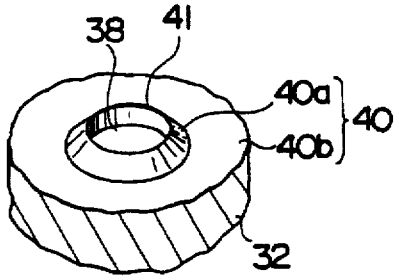
FIG. 3B is a perspective view showing a part of a shaping member in FIG. 3A.

FIGS. 3A and 3B show a method of winding a coil in the electroacoustic transducer according to an embodiment of the present invention.

It employs a holding member 31 for holding the pole piece portion 2. The holding member 31 is a chuck for holding the pole piece portion 2 around which the coil 10 is to be wound. The holding member 31 comprises a recess 34 for holding the yoke 4 of the pole piece portion 2 at the front side thereof and an axial portion 36 at the rear side thereof. The axial portion 36 is connected to a rotating means such as a motor etc., not shown, thereby to be rotated as indicated by an arrow N in accordance with the number of turns of the coil 10.

A shaping member 32 for shaping the side surface 14 is set on the tip end surface side of the pole 6 of the pole piece portion 2 to be confronted with the holding member 31. The shaping member 32 comprises a recess 38 formed at a position corresponding to the tip end surface 12 of the pole 6 and a shaping surface 40 around the recess 38 as illustrated in FIG. 3B. In the case of this embodiment, the shaping surface 40 is composed of a first shaping surface **40*a* and a second shaping surface 40*b*. That is, the internal surface of the yoke 4 of the pole piece portion 2 which is held by the holding member 31 and the first and second shaping surfaces 40*a* and 40*b* define a space 43 in which the coil 10 is to be wound. The first shaping surface 40*a* is conical to form the first side surface 14*a* of the side surface 14. The height of the first shaping surface 40*a* equals to the height D of the first side surface 14*a*. The second shaping surface 40*b* is formed flat to correspond to the second side surface 14*b* so as to form a surface perpendicular to the central axis of the coil 10. In this embodiment, the second shaping surface 40*b* forms the side surface which is on a plane conforming or adjacent to the end surface of the pole 6**.

An axial portion 42 is provided at the rear portion of the shaping member 32. The axial portion 42 is supported to be rotatable by the rotation of the pole piece portion 2.

Before the coil 10 is wound around the pole 6, the pole 6 is attached to the yoke 4 to integrally form the pole piece portion 2. The yoke 4 of the pole piece portion 2 is embedded in the recess 34 of the holding member 31 to be held thereby while the recess 38 of the shaping member 32 is fitted onto the tip end surface 12 side of the pole 6.

Thereafter a wire 44 to form the coil 10 is introduced from a bobbin 46 to the pole 6 side and the holding member 31 is rotated by way of the axial portion 36. As a result, the wire 44 is wound around the pole 6 to gradually form the coil 10 as the holding member 31 is rotated and the first and second side surfaces **14*a* and 14*b* are formed on the shaping surface 40 of the shaping member 32 at the tip end surface 12 side of the pole 6. In this case, a shape fixing agent may be dropped to the coil 10 to fix the same in shape. In case the wire 44 is beforehand coated with the shape fixing agent to form the coil 10** having a stable shape, dropping such a shape fixing agent is not necessary.

Winding the coil 10 using such a shaping member 32 can increase the number of turns of the coil 10 without wasting a winding space for holding the pole 6 by the shaping member 32 and thereby increases the winding efficiency of the coil 10 on the pole 6. Moreover, assembling the pole piece portion 2 and winding the coil 10 may be continuously performed for automation.

Although the second shaping surface **40*b* of the shaping member 32 is on the same plane as the bottom surface of the recess 38 according to this embodiment, it is not a necessary condition, and in case the second side surface 14*b* of the coil 10 is not on the same plane as the tip end surface 12 of the pole 6**, they are arranged properly relative to each other as occasion demands.

Although this embodiment exemplifies a case wherein the ends of the coil 10 are used as terminals, notches or through holes may be formed in the holding member 31 for passing lead terminals in case the same are provided on the rear side of the yoke 4 and the existence of the lead terminals formed on the yoke 4 does not matter at all in holding the yoke 4 by the holding member 31.

The surfaces of the first and second shaping surfaces **40*a* and 40*b* may be subjected to Teflon coating or mirror finish to be easily separated from the first and second side surfaces 14*a* and 14*b* of the coil 10** after the same has been wounded.

Figure 4:
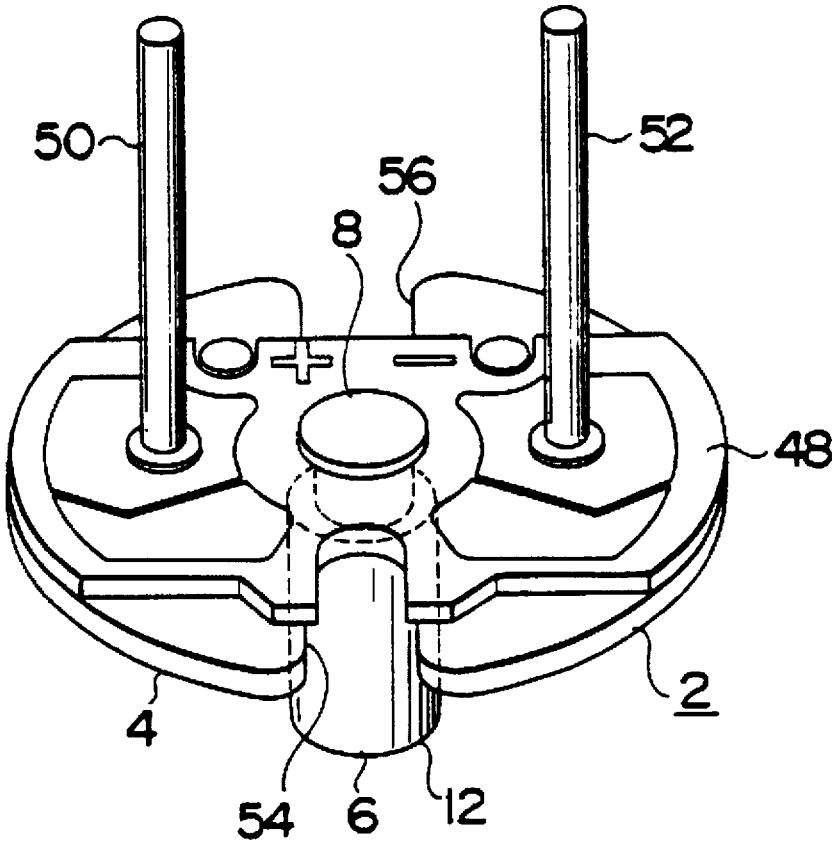
FIG. 4 is a perspective view of the pole piece portion of the electroacoustic transducer viewed from the rear side thereof.
Figure 5A:
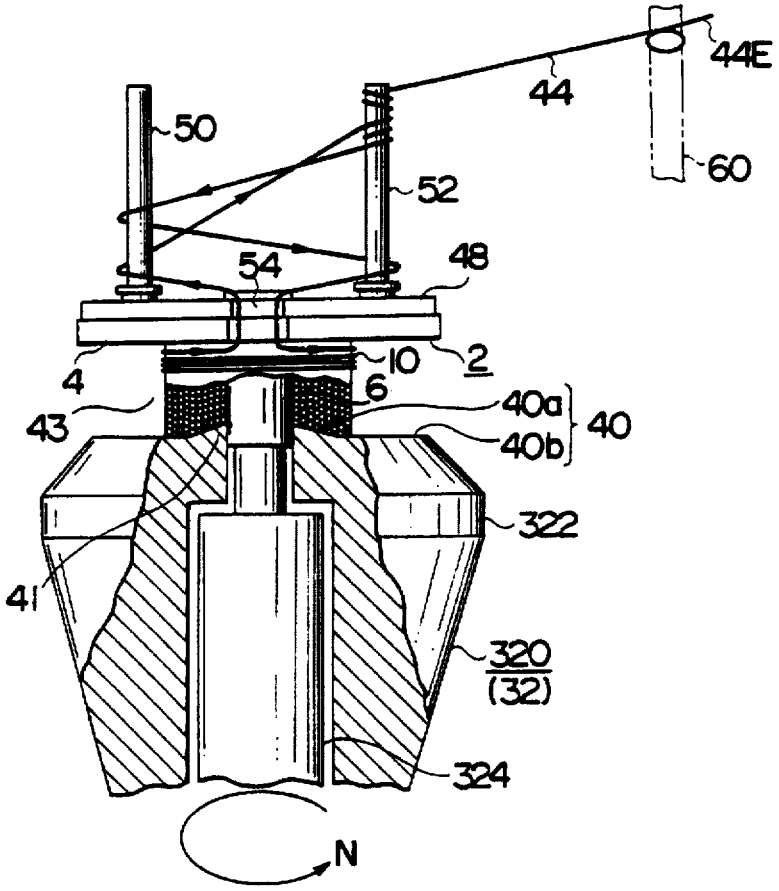
FIG. 5A is a partially cross-sectional view of the electroacoustic transducer showing a concrete example of a method of winding the coil according to the present invention.
Figure 5B:
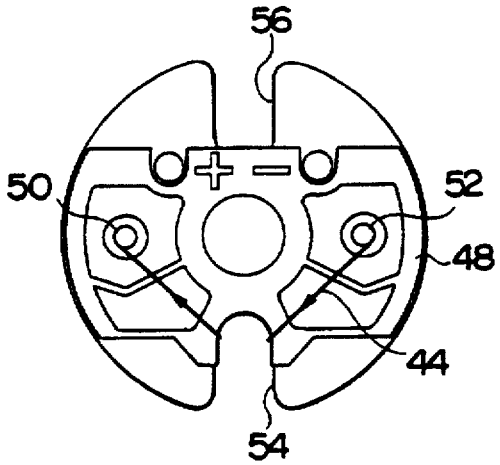
FIG. 5B is a rear view of the pole piece portion showing the movement of a wire relative thereto.

FIGS. 4, 5A and 5B show the method of winding a coil in the electroacoustic transducer according to another embodiment of the present invention.

As illustrated in FIG. 4, a base plate 48 made of insulating material is provided at the rear side of the yoke 4 of the pole piece portion 2. Terminals 50 and 52 to be connected to the end portions of the coil 10 are provided upright at the rear side thereof. The pole 6 is provided upright at the upper surface side of the yoke 4 by piercing the central portions of the yoke 4 and the base plate 48 at the base end portion 8 thereof having a columnar shape.

U-shaped notches 54 and 56 are formed in the yoke 4 of the pole piece portion 2 and the base plate 48 at the respective sides thereof between the terminals 50 and 52. These notches 54 and 56 constitute a means for passing the wire 44 between the pole 6 and the terminals 50 and 52.

A chuck 320 is provided as the shaping member 32 which is the shaping means of the coil 10 as well as the holding means of the tip end portion of the pole 6 of the pole piece portion 2. The tip end portion of the pole 6 of the pole piece portion 2 is held by a pawl portion 322 which is closably divided into multiple pieces, e.g., three pieces. The pawl portion 322 of the chuck 320 comprises a holding projection 41 at the side of the end surface thereof, the end surface of the holding projection 41 being composed of a first shaping surface **40*a* forming a conical surface arranged at the central portion thereof and a second shaping surface 40*b* forming a flat surface arranged around the first shaping surface 40*a*. That is, the first and second shaping surfaces 40*a* and 40*b* and the internal surface of the yoke 4 define the space 43 in which the coil 10** is wound.

Moreover in this embodiment, the chuck 320 is provided with a pin 324 which is surrounded by the multiply divided pawl portion 322. The pin 324 is freely slidable to determine the holding length of the pole 6 by the position of the tip end thereof. Projecting the pin 324 facilitates the separation of the pole piece portion 2 from the chuck 320 after the coil 10 has been wound.

When the coil 10 is wound around the pole 6, as illustrated in FIG. 5A, the starting portion 44E of the wire 44 is retained by a retaining member 60, then the tip of the wire 44 is wound around the terminal 52 and is introduced to the pole 6 side by way of the terminal 50 through the U-shaped notch 54, thereafter the chuck 320 is rotated in the direction indicated by the arrow N to wind the wire 44 around the pole 6 in the space 43 to form the coil 10 in a predetermined shape. Then the tip of the wire 44 is introduced to the terminal 50 side by way of the U-shaped notch 54 to be wound therearound so as to complete the winding process. In this case, FIG. 5B illustrates the introduction and drawing out of the wire 44 between the pole 6 side and the terminal 50 and 52 side by way of the U-shaped notch 54 of the pole piece portion 2 and the arrow indicates the direction thereof.

The wire 44 can be wound around the pole 6 starting on the surface thereof along the first and second shaping surfaces **40*a* and 40*b* by rotating the chuck 320 in the direction of the arrow N so that the coil 10 as high as the pole 6 is formed with the peripheral surface of the tip end surface 12 side of the pole 6 exposed as illustrated in FIG. 2**.

As described above, employing the chuck 320 to hold the pole 6 of the pole piece portion 2 for winding the coil 10 therearound as illustrated in FIG. 2 obviates the holding member 31. It simplifies not only the whole device but also the winding process since the process for the holding member 31 is eliminated. Moreover, in case the pole 6 of the pole piece portion 2 is held by the chuck 320 as in this embodiment, the yoke 4 side of the pole piece portion 2 can be a free end, which has an advantage that even if bar terminals are provided thereon, there is no need to pass the same through the holding member 31 side of the pole piece portion 2.

Also in this method, however, the coil 10 may be wound around the pole piece portion 2 while the yoke 4 side thereof is held by the holding member 31. Holding the pole 6 of the pole piece portion 2 at both ends thereof in this way will be able to restrain vibration due to the rotation thereof and further increase the winding accuracy.

Moreover, also in this embodiment, the first and second shaping surfaces **40*a* and 40*b* of the pawl portion 322 may be subjected to Teflon coating or mirror finish to facilitate the separation thereof from the first and second side surfaces 14*a* and 14*b* of the coil 10** after the same has been wound.

Since the pawl portion 322 of the chuck 320 is divided into multiple portions such as three, the tip end portion of the pole 6 of the pole piece portion 2 can be held or released by closing or opening the divided portions. Upon completion of winding the coil 10, the pawl portion 322 may be opened to let the pole piece portion 2 drop by gravity, but in case it won't drop, a means such as air blast may be used to help it to drop.

As described above, the electroacoustic transducer according to the present invention can increase the winding efficiency of a coil on the pole of the pole piece portion by effectively making use of a given limited space without securing a particular space for winding the coil therein, so that it is possible to obtain a high sound pressure, miniaturize and flatten the electroacoustic transducer and automate the winding process of the coil.

Moreover, the method of winding a coil in the electroacoustic transducer according to the present invention can increase the winding efficiency of the coil and speed up the winding process so as to increase mass productivity.

Although the features of the present invention have been described with reference to preferred embodiments, it is to be understood that many variations and changes are possible in the invention without departing from the scope thereof.

What is claimed is:

1. A method of winding a coil in an electroacoustic transducer for vibrating a diaphragm by a magnetic field generated in response to an inputted electric signal to convert said electric signal into sound, the method comprising the steps of:

holding a yoke side of a pole piece portion including a yoke and a solid pole extending from an upper surface of said yoke;

positioning a shaping member on an outer tip end of said pole;

said shaping member having a holding projection which has a recess for receiving said tip end side of said pole therein, a first shaping surface which is a frusto-conical surface formed at a central portion of said holding projection, and a second shaping surface which is set on a flat plane coplanar or adjacent to a tip end surface of said pole;

winding a wire around said pole in a space defined between an internal surface of said yoke of said pole piece portion and said first and second shaping surfaces of said shaping member so as to form said coil; and removing the shaping member from the pole tip thereby exposing the pole tip and corresponding end of the winding.

2. A method of winding a coil in an electroacoustic transducer for vibrating a diaphragm by a magnetic field generated in response to an inputted electric signal to convert said electric signal into sound, the method comprising the steps of:

holding a tip end portion side of a solid pole piece portion including a yoke and said pole provided on an upper surface of said yoke, the holding occurring only by a shaping member having a shaping surface; said shaping member having a holding projection for holding said tip end portion of said pole therein; said shaping surface having a first shaping surface which is frusto-conical and formed in a central portion of an end surface of said holding projection and a second shaping surface which is set on a flat plane coplanar or adjacent to a tip end surface of said pole;

winding a wire around said pole in a space defined between an internal surface of said yoke of said pole piece portion and said first and second shaping surfaces of said shaping member so as to form said coil; and removing the shaping member from the pole tip thereby exposing the pole tip and corresponding end of the winding.

3. A method of winding a coil according to claim 2, wherein said shaping member is a chuck which holds said tip end portion of said pole of said pole piece portion, and said first and second shaping surfaces are formed by a pawl portion of said chuck.

* * * * *